United States Patent [19]

Gray, deceased et al.

[11] 4,275,487

[45] Jun. 30, 1981

[54] WELL CASING SPIDER

[76] Inventors: Charles E. Gray, deceased, late of Jena, La.; Emma D. W. Gray, executrix, c/o B. G. Tool Co. Inc., P.O. Box 966, Jena, La. 71342

[21] Appl. No.: 952

[22] Filed: Jan. 4, 1979

[51] Int. Cl.[3] ..... A44B 21/00; E21B 19/07

[52] U.S. Cl. ..... 24/263 DC; 294/102 A

[58] Field of Search ..... 24/263 CA, 263 D, 263 DC, 24/263 DB, 263 DT, 263 SW, 263 SB, 263 DA, 249 DP; 294/102 A

[56] References Cited

U.S. PATENT DOCUMENTS

| | | | |
|---|---|---|---|
| 1,693,478 | 4/1928 | Davis | 24/263 CA |
| 1,836,096 | 12/1931 | Hoffoss et al. | 24/263 DC |
| 1,928,283 | 8/1933 | Stokes | 24/263 DC |
| 2,274,273 | 2/1942 | Miller | 24/263 CA |
| 2,890,513 | 6/1959 | Lane | 24/263 CA |
| 3,675,278 | 7/1972 | Powell | 24/249 DP |
| 4,035,012 | 7/1977 | Gvier | 24/249 DP |

*Primary Examiner*—Alexander Grosz

*Attorney, Agent, or Firm*—Sughrue, Rothwell, Mion, Zinn and Macpeak

[57] ABSTRACT

A tapered, hollow bowl of a well spider fitted to an elongated base member and supporting a circumferential array of well casing gripping slips mounted within the bowl for vertical movement to radially enlarge and contract a circular hole within the center of the slip receiving the well casing is segmented to include a pivotable door which carries at least one of the slips, the door being locked in closed position, but pivoted to open the side of the bowl to permit lateral entry of the well casing through the open door.

5 Claims, 8 Drawing Figures

FIG. 1
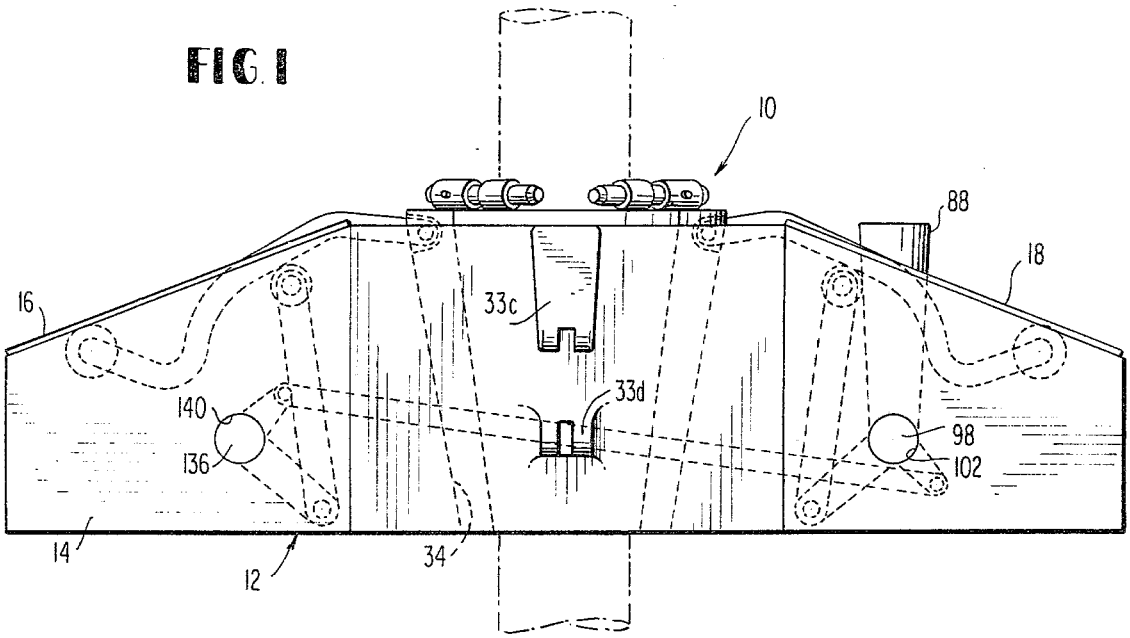
FIG. 2
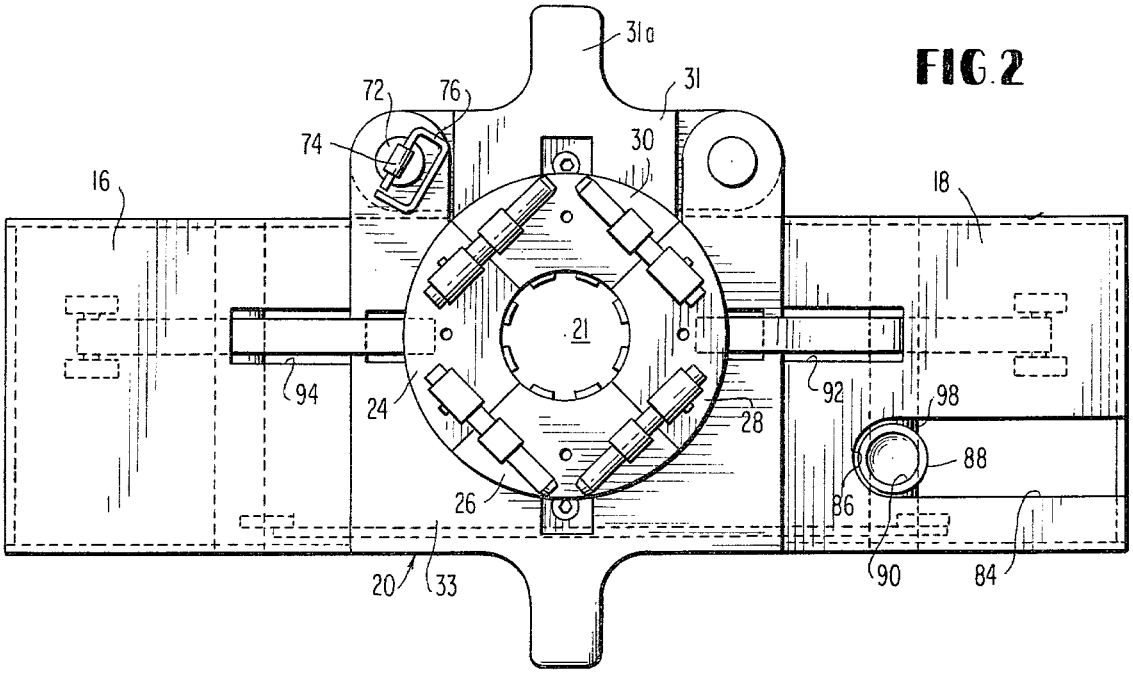
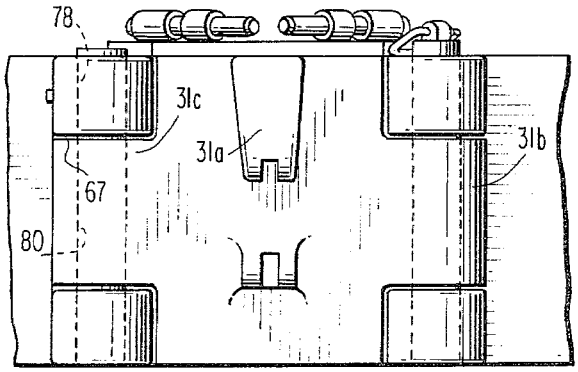
FIG. 3

FIG.4
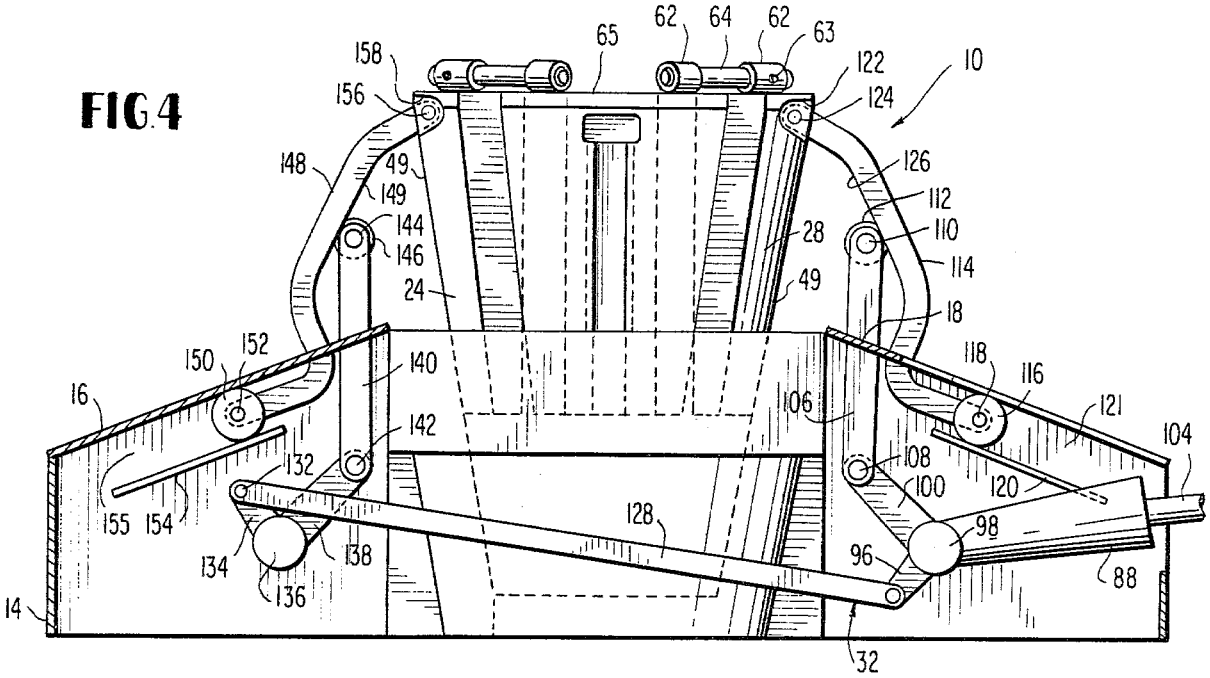
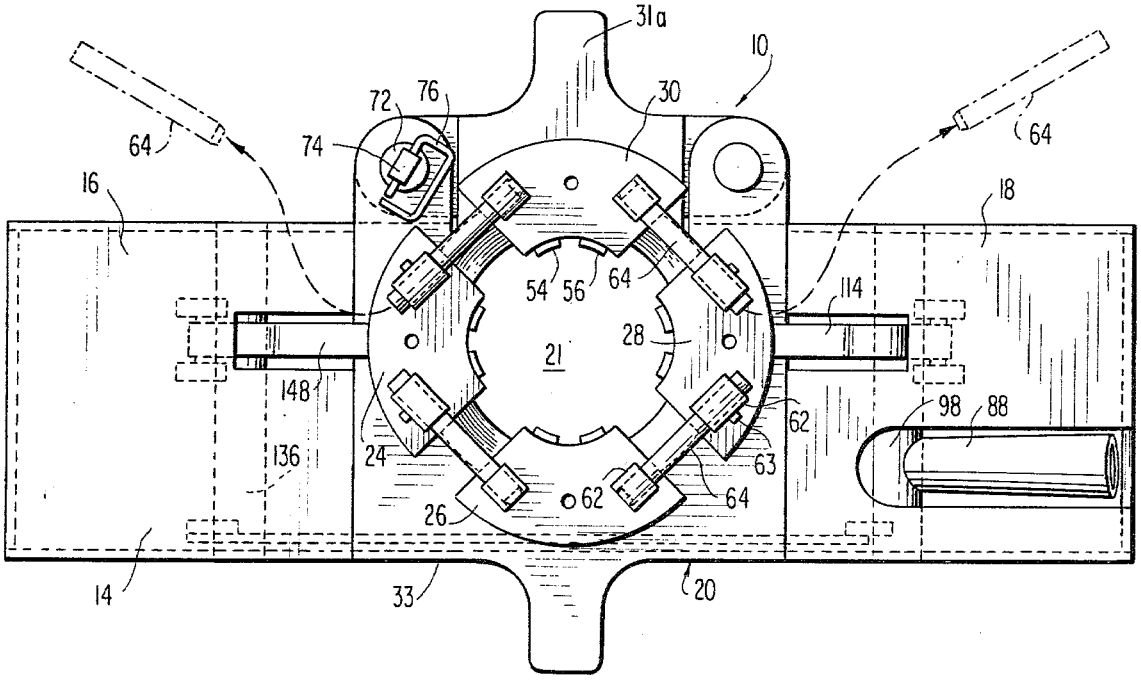
FIG.5

WELL CASING SPIDER

FIELD OF THE INVENTION

This invention relates to oil well casing spiders used in the oil field, and more particularly, to an improved well spider which permits ease in entry and removal of the oil well casing.

BACKGROUND OF THE INVENTION

To effect the lowering and raising of long strings of oil well casing, it is conventional to employ an elongated spider which is open at the center to permit the well casing to be moved rapidly through the central opening of the spider, while operations are proceeding normally but which will permit the firm grasp of the casing when required as during an emergency. Conventionally, a plurality of arcuate wedge shaped sector like elements or slips formed of cast metal such as steel are borne by a spider bowl which is hollow and whose interior surface tapers upwardly and outwardly, upon which are carried the slips. The slips ride on the tapered surface of the spider bowl, being normally keyed thereto and means are provided for simultaneously raising and lowering the slips in contact with the tapered surface of the hollow spider bowl such that, when the slips are raised, they also move radially away from each other to increase the size of the opening defined by the slips through which passes the well casing.

One such type of well spider is shown in U.S. Pat. No. 2,274,273 issuing Feb. 24, 1972, to Earl J. Miller.

While the well spider of that construction functions adequately to perform its given task, it is necessary to physically shift the spider between extreme vertical heights with respect to the well casing, normally requiring the unit to be raised above the upper end of the well casing or well casing section to be grasped, prior to lowering the spider into a position where, when needed, the slips may be shifted on their keyways relative to the bowl and the spider base member to frictionally grasp the periphery of the well casing projecting therethrough. Further, the mechanical actuating and slip interior section mechanism is generally out of direct access.

It is, therefore, a primary object of the present invention to provide an improved oil well casing spider which can be quickly positioned with respect to the oil casing without the necessity of vertically raising the spider above the casing and which can be moved into casing encompassing position at any desired vertical level with respect to the casing in question.

It is a further object of the present invention to provide an improved well spider of this type in which the spider may be moved laterally relative to the well casing to effect the surrounding of the well casing by the slips carried by the well spider without the necessity of modifying or removing the mechanism carried by the spider base member for achieving relative movement between the slips and the hollow bowl supporting the same.

SUMMARY OF THE INVENTION

The improved well spider of the present invention comprises an elongated base member which supports a tapered hollow bowl within which is positioned a circumferential array of well casing gripping slips which are mounted within the bowl and in surface contact therewith and forming a circular hole within the center of the slips to receive the well casing. The slips are mounted for vertical upward and downward movement to effect radial enlargement and contraction of the circular hole, respectively. Means carried by the base and operatively connected to given ones of the slips effect vertical movement of all slips relative to the bowl. The improvement resides in segmenting the bowl to form a door carrying at least one of the slips which is openable laterally to permit the well casing to enter the bowl laterally through the open door and for centering within the circular hole. Preferably, the door is hinged at one side to the bowl proper and carries a floating slip which is readily, removably pin connected to a given driving slip immediately adjacent thereto.

BRIEF DESCRIPTION OF THE DRAWINGS

FIG. 1 is a side elevational view of the improved well spider of the present invention in operation and surrounding a well casing, shown in dotted lines, which passes through the center of the same.

FIG. 2 is a top plan view of the well casing of FIG. 1.

FIG. 3 is a rear elevational view of a portion of the well spider of FIG. 1 showing the pivotable door bowl segment, forming a principal element thereof.

FIG. 4 is a vertical sectional view of the spider with the slips in raised position.

FIG. 5 is a top plan view of the spider showing the nature of pin removal for coupling of the slips.

DESCRIPTION OF THE PREFERRED EMBODIMENT

Figure 6:
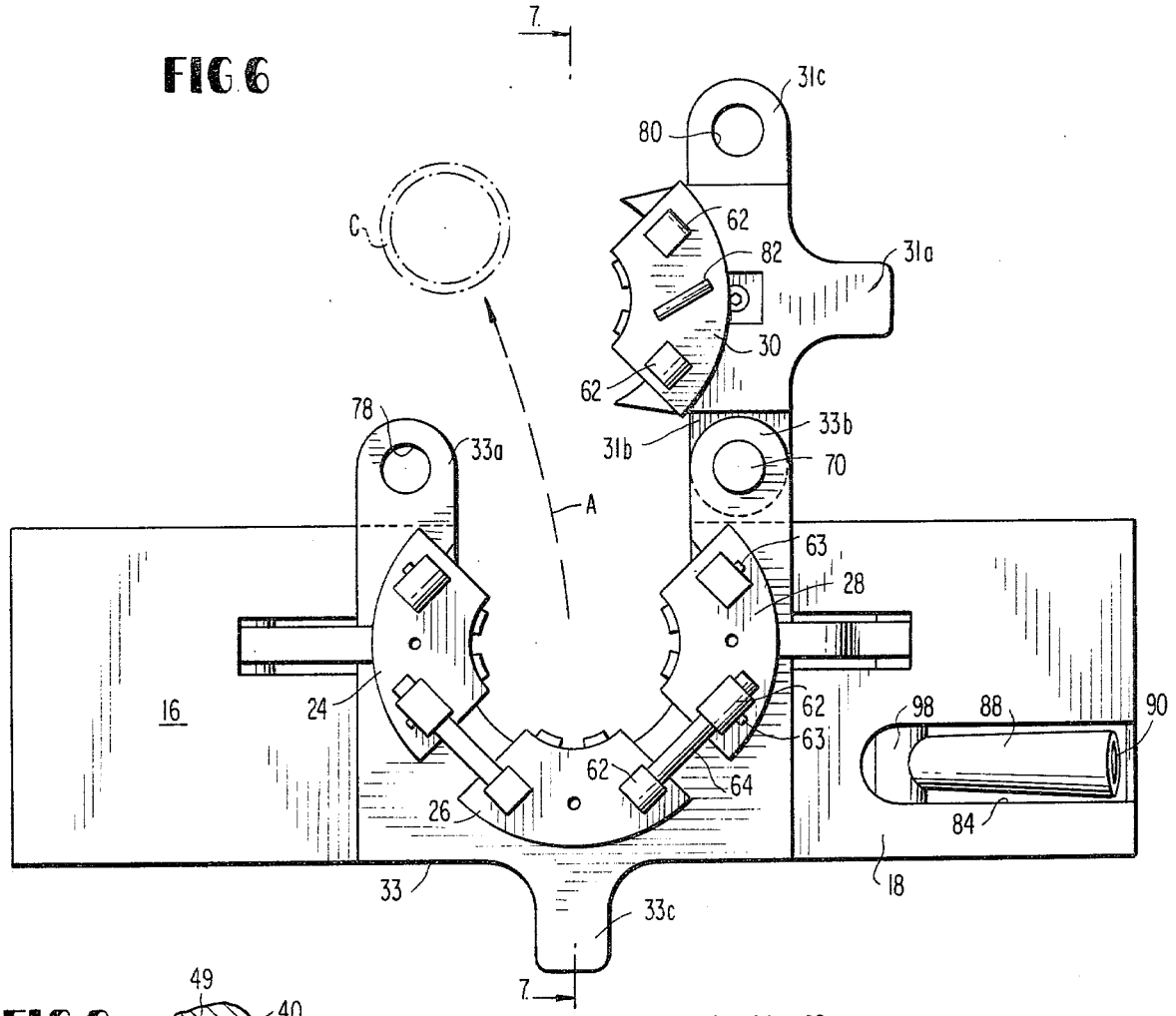
FIG. 6 is a top plan view similar to that of FIG. 2 with the door in open position for a lateral movement to encompass the well casing.
Figure 8:
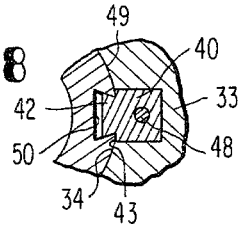
FIG. 8 is a horizontal sectional view of a portion of the well spider of the present invention showing the method of keying of the slips to the bowl segments.

The improved well casing spider indicated generally at 10 in the drawing includes a base or body indicated generally at 12 of rectangular, elongated form in top plan configuration in the form of a fabricated steel structure or steel casting including a rectangular base 14, open at the bottom and closed at the top, on each side, by cover plates 16 and 18 extending transversely from side to side. The cover plates do not extend completely across the top of the structure, the center portion being open and receiving by way of fixed mounting as by welding or the like, a downwardly inwardly tapered inner surface hollow annular bowl indicated generally at 20 which in top plan view is generally of rectangular form and being wider than the base. Bowl 20 is open at the center as at 21 and is provided with a tapered inner surface at 34. The annular bowl 20 is segmented into two parts or sections, including a pivotable door indicated generally at 31 which is pivoted to the second part or main section 33 of bowl 20. The bowl 20 acts to support on the tapered surface 34 individual slips as at 24, 26, 28 and 30, the slips 24 and 28 constituting driving slips, while slips 26 and 30 constitute floating slips. Slip 30 is carried on the tapered surface portion of the pivotable bowl door 31. The downwardly and inwardly tapered surface 34 of the hollow bowl 20 is uniformly in taper, the upper end of the tapered surface 34 being recessed as at 36 and 38 at circumferentially spaced locations so as to receive rectangular blocks 40 which include a key 42 projecting outwardly from a surface portion or side wall 43 which is parallel to and constitutes an extension of the tapered surface 34 of the bowl. Vertical bore 44 within the block 40 and tapped and threaded holes 46 within the spider bowl 20 allow the blocks 40 to be rigidly mounted to the bowl proper and to the door 31 via screws 48.

The keys 42 fit within keyways 50 of like keystone horizontal cross-section provided within confronting radially outer surfaces 49 of the individual slips 24, 26, 28 and 30 having a taper matching that of the bowl and door. The radially inner surface 60 of each of the slips bears parallel, narrow, radially outward projecting ribs as at 54, 56 which are serrated as at 58 to grip the well casing C, FIGS. 1 and 6, the slips being formed of steel or the like.

As mentioned previously, the diametrically opposed slips 24 and 28 constitute driving slips and are driven positively by a mechanical operating mechanism indicated generally at 32, FIG. 4. The slips 26 and 30 which are interposed between slips 24 and 28 and which are opposite each other are floating or driven slips and are pin connected to the slips 24 and to the slip 28 such that as the slips 24 and 28 are positively moved or lifted on the inclined bowl surface 34, guided by the keys of the bowl proper and the door through the keyways within the individual slips, they tend to move radially outwards, away from each other. However, they remain linked together by dowel pins 64.

In contrast to the prior art, where the dowel pins are located below the upper ends of the slips and are difficult to reach and tend to hang up, another aspect of the present invention is the location of these pins externally for easy access, lubrication, etc. In that respect, the upper end face 65 of each slip is provided with a pair of short length tubes or sleeves 62 which are welded to the slips, are mounted with their axes at right angles to each other and face corresponding tubes or sleeves on the ends 65 of adjacent slips. The tubes or sleeves 62 are of a diameter so as to slidably receive the dowel pins 64. However, the pins 64 are locked within given ones of the tubes 62 as by locking screws 63 which are threaded through the sleeve or tube 62 within a radial hole within the side of the same such that the end of the screw bears on the periphery of the pin 64 to lock and prevent axial movement of the same within that tube. The pin 64 is free to slide within the aligned tube 62 on the adjacent slip so that during raising and lowering of the slips, the slips may separate circumferentially as they move radially outward with respect to the axis of the assembly and the center of the hole formed by these members and the tapered bowl 20.

Figure 7:
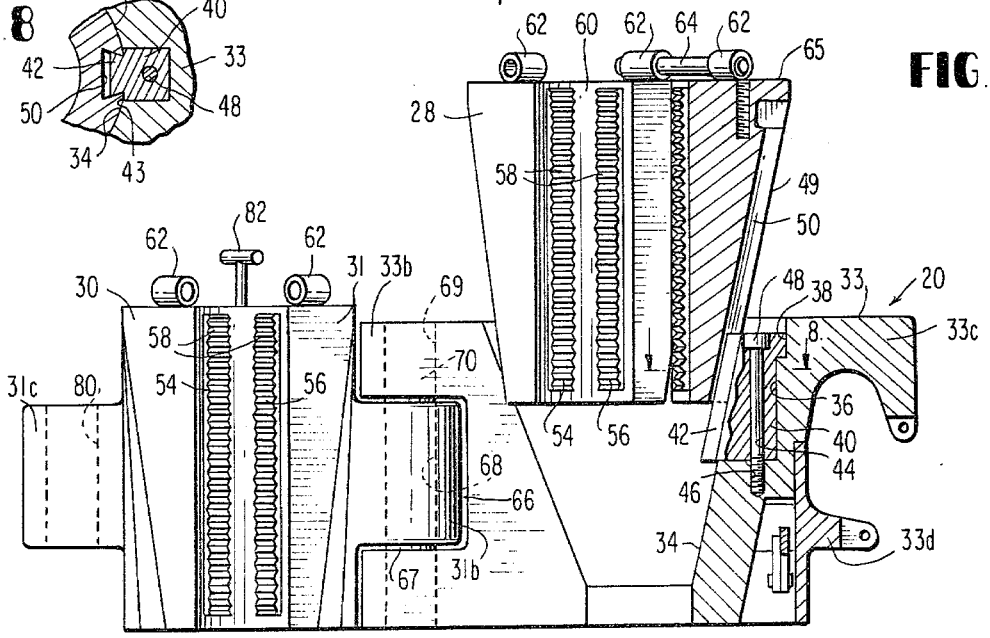
FIG. 7 is a vertical sectional view of the well spider of FIG. 6 taken about line 7—7.

A principal aspect of the present invention resides in the means for opening the bowl laterally to permit the lateral acceptance of a well casing as at C, FIG. 6. This eliminates the necessity of an axial or end envelopment of a casing section or a string of casings. All of this is achieved without interference with the action of the multiple slips in their normal function subsequent to closing of the bowl and without adversely affecting the robust nature of the spider. In the illustrated embodiment, this is achieved by the utilization of a pivotable door 31 which forms one complete sidewall or quarter section of the spider bowl assembly. In that respect, as best seen in FIGS. 6 and 7, the bowl section 33 is provided with paired flange wall sections as at 33*a* and 33*b*, the flange sections being appropriately recessed at, for instance, 66 for flange section 33*b*, FIG. 7, forming a clevis type hinge joint for the door 31. The flange section 33*b* is bored as at 69, FIG. 7, and receives a metal pivot pin 70 which may be sized so as to frictionally fit within the bore 69 of that member, while it is of slightly smaller diameter than the diameter of a bore 68 within projecting lug 31*b* of the door 31, acting as a pivotable hinge member for door 31. A similar sized and configured lug 31*c* projects from the opposite side of the door 31 and bears a bore as at 80 whch is of a diameter corresponding to the diameter of bore 78 within flange 33*a* of the annular bowl section 33.

As seen in FIG. 3, flange 33*a* is recessed at 67 intermediate the top and bottom to permit the lug 31*c* to move into a position with the door closed such that bore 80 is aligned with bore 78 at the top and bottom of flange 20*b* and permitting the door to be locked in closed positon through the utilization of a locking pin 72. Pin 72 is of cylindrical shape and of a diameter on the order of the diameter of bores 78 and 80 of flange 20*b* and lug 31*c*, respectively. Pin 72 bears a central projection 74 at its upper end which hingedly carries an O-ring 76, permitting by grasping of the O-ring 76, the lifting of the locking pin 72 so as to release the door and permit it to swing outwardly to open position as shown in FIG. 6. It is at this point that the well casing C can be positioned coaxially with the annular bore by moving the spider relative to the well casing C as indicated by the arrow A, FIG. 6. Further, the slip 30 associated with the door and carried by the door 31 is provided with a T handle 82 which projects upwardly from the top 65 of slip 30 intermediate of the sleeves 62 to permit, irrespective of the mechanism 32, the lifting of the slip 30 relative to its key 42 along the tapered surface 34 of that member.

Additionally, as a means for transporting the spider, the door 31 is provided with a lug as at 31*a*, while diametrically opposite, the annular bowl section 33 is provided with a corresponding lug as at 33*c*, each taking the form of a hook and overlying a projection, as at 33*d* for the annular bowl section 33, and only one being shown.

To effect the raising and lowering of the slips from the position shown in FIG. 1 to the position shown in FIG. 4 and return of the same, the mechanism 32 is employed. This mechanism comprises elements which pass through the cover 16 and 18 and which connect to the driving slips 24 and 28. In that respect, the cover plate 16 is slotted as at 94 intermediate of the sides and remote from the end of the base 14, there also being a corresponding slot 92 within cover 18. Cover 18 also includes a slot 84 which extends inwardly from one end of the base toward the bowl, terminating short of the bowl and being rounded as at 86, FIG. 2. Mounted transversely to the base 14 for rotation intermediate of its sides are transverse shafts 98 and 136. Shaft 98 is mounted for rotation within bushings as at 102 formed within opposed sidewalls of base 14. On the left side of the bowl a similar transverse shaft 136 is provided which is mounted for rotation within bushings 140 provided by opposed sidewalls of the base 14 underlying cover plate 16. A tapered lever 88 which is hollow to define a socket 90 is fixed to the transverse shaft 98 and extends radially outwardly of the same, being aligned with the slot 84 so as to project through the slot when the lever is rotated to vertical position, FIG. 1. The socket 90 receives a handle as at 104, FIG. 4, to effect movement between extreme positions as contrasted in FIGS. 1 and 4. The lever 88 operates bell crank arms 96 and 100 which are fixed to the transverse shaft 98, being generally at right angles to each other. The bell crank arm 100 is pin connected by pin 108 to a link 106 which terminates at its upper end in a roller 112 which rotates about pin 110 carried by link 106 and which roller contacts surface 126 of a goose neck 114. The goose neck 114 is provided at its upper end by pivot pin 124 to driving slip 28 by way of recess 122 within the radial outside tapered sidewall 49 of that member, the goose neck 114 being of modified L-shape in vertical configuration and terminating at an opposite end in paired rollers as at 116, being mounted to the goose neck via pin 118. The rollers rotate about the pin axis and are in contact on opposite sides with the bottom of the cover plate 18 on respective sides of slot 92, and a transversely extending plate 120 spanning between the opposed sides of base 14 and defining a track or guideway 121 for the rollers 118. Plate 120 is parallel to cover plate 18 such that the rollers ride up and down during raising and lowering of the slips. The other bell crank arm 96 is pin connected to one end of a connecting rod 128 which spans across and to the side of the hollow, annular bowl 20, terminating beneath cover plate 16 on the left and being pin connected by pin 132 at that end to a crank arm 134 fixed to the transverse shaft 136. A second crank arm 138 is fixed to that shaft underlying the slot 94 within cover 16, and is pin connected at its outboard end by way of pin 142 to one end of link 140. The link bears a roller 146 which rotates about the axis of a pin 144 carried by the link 140 and the roller 146 is in contact with face 149 of a second gooseneck 148. The upper end of the goose neck 148 is pin connected by pin 156 to the opposite driving slip 24 from slip 28 at a recess 158 within the outer peripheral wall 49 of that annular member. The lower end of the goose neck bears a pair of rollers 150 on each side thereof which rotate about an axis of rotation as defined by pin 152 on which they are mounted. The rollers 150 contact on the top, the bottom, surface of cover plate 16, to each side of slot 94, and on the bottom a transversely extending plate 154 defining a track or guideway 155 at the left of the spider assembly. Alternatively, instead of rollers 112 and 146, the upper ends of the links 106 and 140 may be clevis connected to the goose necks 114 and 148 respectively, intermediate of their ends.

The operation of the improved spider may be appreciated from the above description and a review of the drawings. However, briefly, in accordance with FIG. 6, in order to place the spider in a position such that the slips and the annular bowl encompass the well casing C, it is required that ring 76 be grasped so as to lift the locking pin 72 to free the pivotable door 31 so that the door 31 can be pivoted to open position, FIG. 6, permitting the spider to be moved in the direction of the arrow A to place the well casing C coaxially with respect to assembly 10. The handle 82 may be employed or alternatively the door 31 may be otherwise pivoted about the axis as defined by pin 70 to close the door at which point the locking pin can be inserted within aligned bores 70 and 80 of the annular bowl flange **20*b* and lug 31*c* of the door 31 effecting locking of the door with the four slips in well casing confronting position. The slips may be in raised position or lowered position. It is possible to manually arrange the slip 30 to its uppermost position such that the upper surfaces 65, the upper ends of all of the slips are coplanar when slips 24, 26 and 28 are in raised position. In either raised or lowered position, the dowel pins 64 can be manually slid within the sleeves 62 of all slips on their ends so as to enter the sleeves 62 carried on the upper surface 65 of adjacent slips. The pins 64 may then be locked in that position by means of the set screws 63 and the mechanism in condition for operation. The handle 104 may be inserted within the socket 90 of lever 88 and the lever rotated from its near horizontal position as shown in FIG. 4 to its vertically raised position as seen in FIGS. 1 and 2 to effect lowering of the slips and frictional grasping of the well casing C uniformly about the outer periphery of the same by contact with the serrated ribs 54 and 56 of the individual slips 24, 26, 28 and 30. At the same time, because of the location and nature of the dowel pins 64 and the sleeves or tubes 62**, raising and lowering of the slips as a unit is facilitated while permitting their radial spacing. The pin couplings are provided in free access position for purposes of lubrication, replacement of broken dowel pins and the like, constituting a marked improvement over the prior art apparatus as evidenced by the reference U.S. Pat. No. 2,274,273.

While the invention has been particularly shown and described with reference to a preferred embodiment thereof, it will be understood by those skilled in the art that various changes in form and details may be made therein without departing from the spirit and scope of the invention.

What is claimed is:

1. A well casing spider comprising:

a unitary elongated base member;

a bowl for said base member;

said bowl segmented in two sections, one section fixedly secured within said base member, the other section pivotedly attached to said one section and forming a door for said bowl and base member;

arcuate segments vertically movable within said one section;

an arcuate segment carried on and moveable relative to said pivotable door;

means attached to diametrically opposed arcuate segments within said one section for effecting vertical movement thereof; and means linking said diametrically opposed arcuate segments to an adjacent arcuate segment within said one section and to the arcuate segment on said door whereby upon operation of said vertically moving means all of said arcuate segments move vertically in unison.

2. An improved, lateral access well spider comprising:

an elongated base member having an open side, a tapered hollow bowl fixedly carried thereby, a circumferential array of casing gripping slips mounted within said bowl in surface contact therewith and forming a circular hole within the center thereof to receive a well casing and moveable along the surface of the tapered hollow bowl to effect radial enlargement and contraction of the circular hole formed thereby by upward and downward movement respectively to release and grip said casing, and means carried by said base member for effecting vertical movement of said slips relative to said bowl, the improvement wherein:

said bowl is segmented and includes a non-moveable section carrying a plurality of said slips and a door section carrying at least one of said slips, said door section pivotedly supported on said non-moveable section and operable to selectively form an opening in said circular hole defined by said slips to permit said well casing to enter said bowl, laterally through said opening.

3. The well spider as claimed in claim 2, wherein said segmented bowl comprises first and second sections, said second section being non-movable and integral with said base and said first section comprising a door pivoted at its side to said second section for swinging laterally away from said second section, said door carrying at least one of said slips and permitting direct lateral access to the interior of the remaining of said slips when said door is pivoted to open position.

4. The well spider as claimed in claim 3, wherein said bowl second section comprises stationary spaced centrally recessed flanges, said pivotable door comprises at least one quarter side wall of said bowl having opposed locking lugs projecting outwardly therefrom on opposite ends and wherein said flanges and said lugs carry bores of similar size, and wherein a pivot pin projects through the bore of one of said flanges of said bowl second section and the aligned bore of one of said lugs to define a pivot access for said door, and wherein a removable locking pin is carried within the aligned bores of said opposite door lug and said outer flange of said second section.

5. The well spider as claimed in claim 4, wherein said slips comprise four arcuate segments, the slips carried by said pivotable door and the one diametrically opposite said pivotable door comprise floating segments, and wherein said means carried by said base member for effecting vertical movement to said slips comprise means connected to transversely diametrically opposed slips mounted on said bowl second section intermediate respective sides of the slip carried by said door, and wherein all four slips bear a set of sleeves on their upper surfaces at the circumferential edges of said slips, each set of sleeves being opposed to each other and in axial alignment with sleeves of adjacent slips, and wherein one of said sleeves for each pair has fixedly mounted therein one end of a dowel whose opposite end is slidably received in the other of said sleeves of said pair carried by the adjacent slips thus linking all slips together; whereby upon vertical movement of said transave diametrically opposed slips by said means, said floating slips move vertically therewith; and whereby adjustment of said dowel and sleeve connections between said slips may be easily achieved as well as replacement of broken slips or sleeves upon failure of the same during use.

* * * * *